US010473384B2

(12) United States Patent
Stollenwerck, III

(10) Patent No.: US 10,473,384 B2
(45) Date of Patent: Nov. 12, 2019

(54) COOLER DIVIDER

(71) Applicant: Logan H. Stollenwerck, III, Fredericksburg, TX (US)

(72) Inventor: Logan H. Stollenwerck, III, Fredericksburg, TX (US)

( * ) Notice: Subject to any disclaimer, the term of this patent is extended or adjusted under 35 U.S.C. 154(b) by 0 days.

(21) Appl. No.: 15/907,192

(22) Filed: Feb. 27, 2018

(65) Prior Publication Data

US 2018/0187962 A1 Jul. 5, 2018

Related U.S. Application Data

(63) Continuation-in-part of application No. 15/647,177, filed on Jul. 11, 2017.

(60) Provisional application No. 62/360,508, filed on Jul. 11, 2016, provisional application No. 62/539,503, filed on Jul. 31, 2017.

(51) Int. Cl.
*F25D 23/06* (2006.01)
*F25D 23/08* (2006.01)

(52) U.S. Cl.
CPC ..... *F25D 23/069* (2013.01); *F25D 23/068* (2013.01); *F25D 23/087* (2013.01)

(58) Field of Classification Search
CPC .... F25D 23/068; F25D 23/087; F25D 23/069; F25D 2323/062; F25D 2400/04
USPC ..... 62/457.1
See application file for complete search history.

(56) References Cited

U.S. PATENT DOCUMENTS 1,541,945 A * 6/1925 Hamilton ..... F25D 23/062 220/592.11
2,164,879 A * 7/1939 Mason ..... A24F 25/02 131/301
2,496,296 A * 2/1950 Lobl ..... A45C 11/20 206/545
2,706,895 A * 4/1955 Thompson ..... F25D 3/08 206/199
3,164,395 A * 1/1965 Burch ..... B60P 7/14 410/135
3,287,925 A * 11/1966 Kane ..... F25D 3/105 62/216
3,359,687 A * 12/1967 Wallace ..... B64D 13/04 49/477.1

(Continued)

FOREIGN PATENT DOCUMENTS

BE 1017210 A6 * 5/2008 ..... E06B 9/02
FR 1281572 A * 1/1962 ..... F25D 23/069

OTHER PUBLICATIONS

YETI COOLERS, YETI Cooler Tundra Divider, http://yeticoolers.com/tundra-divider/, printed Mar. 3, 2016.

*Primary Examiner* — Ljiljana V. Ciric

(74) *Attorney, Agent, or Firm* — FisherBroyles LLC; Anthony J DoVale

(57) ABSTRACT

A divider device for dividing an interior chamber of a cooler into a plurality of separate chambers and preventing fluid flow between the plurality of chambers. The divider device has a dividing wall that is insertable into the interior chamber of the cooler. A waterproof seal is positioned around the outer surfaces of the dividing wall. The seal is inflatable by a pump that is part of the divider device such that the seal is urged into contact with walls of the interior chamber to form a fluid-tight seal that prevents fluid flow from a first side of the dividing wall to a second side of the dividing wall.

22 Claims, 10 Drawing Sheets

(56) References Cited

U.S. PATENT DOCUMENTS 3,612,213 A * 10/1971 Piko ..... F04B 39/0038 181/200
3,620,409 A * 11/1971 Rosenbaum ..... F16K 24/04 206/524.8
3,638,450 A * 2/1972 Falk ..... B60P 3/205 62/329
3,782,758 A * 1/1974 Williamson, III ..... B60P 7/14 410/118
RE28,788 E * 4/1976 Williamson, III ..... B60P 7/14 410/118
4,018,585 A * 4/1977 Loratto ..... F25D 3/00 126/204
4,164,312 A 8/1979 Harned
4,532,774 A * 8/1985 Burns ..... B60P 3/20 280/415.1
4,573,202 A * 2/1986 Lee ..... A45C 3/00 190/107
4,889,253 A 12/1989 Schmulian
4,964,528 A * 10/1990 Wagoner ..... B65D 25/06 220/541
4,966,003 A * 10/1990 Shima ..... A23L 3/361 62/125
4,978,023 A 12/1990 Behlmann
5,028,087 A * 7/1991 Ells ..... B60P 3/205 160/327
5,150,809 A 9/1992 Leigh
5,154,502 A 10/1992 Takaoka
5,231,850 A * 8/1993 Morris ..... A47G 23/04 62/457.2
5,295,365 A * 3/1994 Redford ..... F25D 3/08 62/265
5,329,787 A * 7/1994 Friday ..... F25D 3/08 62/372
5,373,780 A * 12/1994 Bianco ..... A01F 25/00 165/61
5,381,940 A 1/1995 Wright
5,566,608 A * 10/1996 Vejdani ..... A23B 7/148 99/467
5,692,632 A * 12/1997 Hsieh ..... B65D 81/20 215/228
5,789,007 A * 8/1998 Bianco ..... A23B 7/152 426/263
5,865,037 A * 2/1999 Bostic ..... B65D 81/2038 220/361
5,918,478 A * 7/1999 Bostic ..... B65D 81/2038 62/371
5,953,931 A * 9/1999 Brittain ..... F25D 21/14 220/371
5,965,185 A * 10/1999 Bianco ..... A23B 7/152 426/263
6,086,128 A * 7/2000 Whitehead, Sr. ..... B60P 7/14 160/354
6,105,654 A 8/2000 Martel
6,192,703 B1 * 2/2001 Salyer ..... C09K 5/066 62/457.7
6,220,473 B1 * 4/2001 Lehman ..... B65D 81/3858 150/901
6,244,066 B1 * 6/2001 LaRose ..... B65D 25/38 220/560
6,308,518 B1 * 10/2001 Hunter ..... F25B 21/02 62/3.3
6,463,756 B1 * 10/2002 Lewis ..... A45D 19/02 62/371
6,626,006 B1 * 9/2003 Tedder ..... F25D 3/08 220/915.2
6,751,969 B1 * 6/2004 Moran ..... B60P 3/205 62/177
6,966,450 B2 11/2005 Askew
7,044,424 B2 * 5/2006 Robertson ..... A47F 3/0439 206/561
7,147,125 B1 * 12/2006 Slovak ..... B65D 81/3818 220/592.2
7,383,964 B2 * 6/2008 Keller ..... F25B 17/08 220/592.27
7,451,614 B2 * 11/2008 Luehrs ..... F25D 11/02 62/441
7,475,782 B2 * 1/2009 Lombardi ..... A01M 31/00 190/110
7,918,093 B2 * 4/2011 Dillon ..... F17O 9/00 62/378
8,016,149 B2 * 9/2011 Goulet ..... H02G 3/081 220/241
8,136,819 B2 3/2012 Yoshitsune
8,256,242 B1 * 9/2012 Evans ..... A45C 13/262 62/457.7
8,347,649 B1 * 1/2013 Gavin ..... E06B 7/2318 292/256.65
8,402,775 B2 * 3/2013 Espinosa ..... A47F 3/001 62/268
8,459,180 B2 * 6/2013 Paupardin ..... F25D 13/067 99/473
8,479,947 B1 * 7/2013 Albrecht, II ..... A45C 11/20 220/524
8,863,546 B2 * 10/2014 Oberweis ..... F25D 3/14 220/23.87
9,182,168 B2 * 11/2015 Hernandez ..... F25D 25/025
9,205,962 B2 12/2015 Holderby
9,469,237 B2 * 10/2016 Lee ..... B62D 33/042
9,668,510 B2 * 6/2017 Doman ..... A23L 3/0155
2001/0032850 A1 * 10/2001 Neuner ..... B65D 53/00 220/232
2004/0237574 A1 * 12/2004 Donald, II ..... B62B 3/00 62/457.7
2005/0060937 A1 * 3/2005 Dondlinger ..... E06B 7/2318 49/118
2007/0000396 A1 * 1/2007 Kieck ..... A47J 47/10 99/476
2007/0023439 A1 * 2/2007 Vaughn ..... F25D 3/08 220/592.03
2007/0044502 A1 3/2007 Hase
2009/0045204 A1 * 2/2009 Marganski ..... A45C 11/20 220/592.03
2009/0056369 A1 * 3/2009 Fink ..... F25D 17/02 62/457.4
2010/0000250 A1 * 1/2010 Sixt ..... A01N 1/02 62/457.2
2010/0008179 A1 1/2010 Lacy
2010/0263398 A1 * 10/2010 Webb ..... F25D 3/08 62/331
2010/0287976 A1 11/2010 Roof
2014/0034655 A1 * 2/2014 Wooldridge ..... B65D 81/3818 220/592.27
2015/0216221 A1 * 8/2015 Doman ..... A23L 3/0155 426/418
2015/0369529 A1 * 12/2015 Monroe ..... F25D 3/08 62/457.2
2017/0119116 A1 * 5/2017 Bradley ..... A45O 7/004

* cited by examiner

COOLER DIVIDER

CROSS-REFERENCE TO RELATED PATENT APPLICATIONS

This application is a continuation-in-part of U.S. application Ser. No. 15/647,177, filed Jul. 11, 2017, which claims the benefit of priority of U.S. Provisional Application No. 62/360,508 filed on Jul. 11, 2016, and this application claims the benefit of priority of U.S. Provisional Application No. 62/539,503 filed on Jul. 31, 2017, the entire disclosure of each of which is hereby incorporated by reference herein in its entirety.

FIELD OF THE INVENTION

The present invention relates generally to a device and system that can be used to divide an interior chamber of a cooler into a plurality of chambers. More specifically, the present invention relates to a device and system comprising a divider for a cooler that separates the interior chamber of the cooler into a plurality of separate chambers and that prevents or restricts fluid flow between the plurality of chambers.

BACKGROUND OF THE INVENTION

The contents of a conventional ice chest or cooler is cooled with ice placed in the cooler. As the ice melts, however, items placed in the cooler often become wet. Over time, more ice in the cooler melts and can submerge all items that accompany it. This can be a significant problem if items in the cooler are lightly packed, for example, as sandwiches and chips typically are. It is possible that the affected items will be completely ruined when submerged.

When using a cooler with hunting and/or fishing, any caught animals such as a fish, bird and the like can be placed in the cooler to prevent the meat from spoiling. However, blood and other fluids from the animal can contaminate items in the cooler. For example, blood from a fish could leak from the fish and onto a beverage can or food item also placed in the cooler.

Accordingly, it is desirable to provide a device for a cooler that can easily separate the interior chamber of the cooler into separate compartments that can prevent water and other fluids from traveling between compartments while allowing heat transfer between the compartments.

SUMMARY

Presented herein are devices and systems for dividing an interior chamber of an ice chest or cooler into a plurality of separate chambers that prevent and/or restrict fluid flow among the plurality of chambers. The system comprises a dividing wall that is selectively insertable into the interior chamber of the cooler. A seal can be positioned around a left edge, a bottom edge, and a right edge of the dividing wall such that the seal can prevent and/or restrict fluid flow from a first side of the dividing wall to a second side of the dividing wall.

In one aspect, the dividing wall can be sized and shaped to correspond to the size and shape of the interior chamber of a cooler so that a complementary relationship can be formed between the dividing wall and an interior wall of the cooler. That is, at least a portion of the dividing wall can matingly engage the interior wall of the cooler. For example, the left edge of the dividing wall can be positioned in contact with or adjacent to a left side of the interior chamber. The right edge of the dividing wall can be positioned in contact with or adjacent to a right side of the interior chamber. The bottom edge of the dividing wall can be positioned in contact with or adjacent to a bottom side of the interior chamber.

The seal can be positioned and/or formed on at least one outer surface of the dividing wall that faces a side of the interior chamber of the cooler. In one aspect, the seal can be formed from a waterproof material such as silicon and the like so that contact between the seal and the wall of the interior chamber can prevent or restrict fluid flow past the seal. In another aspect, at least a portion of the seal can be flexible so that the portion of the seal can conform to the contour of the sides of the interior chamber.

In one aspect, the seal can comprise at least one blade and at least one rib positioned on an outer surface of the dividing wall. The blade can be formed with or positioned adjacent to an edge of the outer wall so that the blade is a continuous blade extending around the left edge, the right edge and the bottom edge of the dividing wall. In another aspect, the blade can extend away from the wall a predetermined distance and at a predetermined angle.

The at least one rib can be formed with or coupled to an outer surface of the dividing wall so that the rib is a continuous rib extending around the left edge, the right edge and the bottom edge of the dividing wall. In another aspect, the rib can be spaced from the blade a predetermined distance.

Alternatively, the seal can comprise at least one pump, at least one inner tube and at least one seal body. The inner tube can be positioned in a wall chamber defined in the dividing wall. The at least one pump can be in fluid communication with the inner tube. The seal body can be coupled to the at least one inner tube and/or a plurality of edges of the of the dividing wall so that the seal body is a continuous seal extending around at least a portion of the left edge, the right edge and the bottom edge of the dividing wall. Inflation of the inner tube with the pump can then urge the seal away from the dividing wall.

In use, the dividing wall can be positioned in the interior chamber of the cooler so that the dividing wall separates the interior chamber into at least two separate chambers. In one aspect, at least a portion of the seal positioned on or adjacent the left edge of the dividing wall can contact a wall of the interior chamber, at least a portion of the seal positioned on or adjacent the bottom edge of the dividing wall can contact the bottom surface of the interior chamber, and at least a portion of the seal positioned on or adjacent the right edge the dividing wall can contact a wall of the interior chamber. In this aspect, the contact between the seal and the wall or surface of the interior chamber can prevent fluid from passing the seal. Thus, the dividing wall placed in the interior chamber of the cooler can separate the interior chamber into two separate chambers, and the seal can prevent fluids from flowing between the two separate chambers.

Related methods of operation are also provided. Other apparatuses, methods, systems, features, and advantages of the devices and systems for dividing an interior chamber of an ice chest or cooler into a plurality of separate chambers will be or become apparent to one with skill in the art upon examination of the following figures and detailed description. It is intended that all such additional apparatuses, methods, systems, features, and advantages be included within this description, be within the scope of the devices and systems for dividing an interior chamber of an ice chest or cooler into a plurality of separate chambers, and be protected by the accompanying claims.

DESCRIPTION OF THE INVENTION

Figure 1:
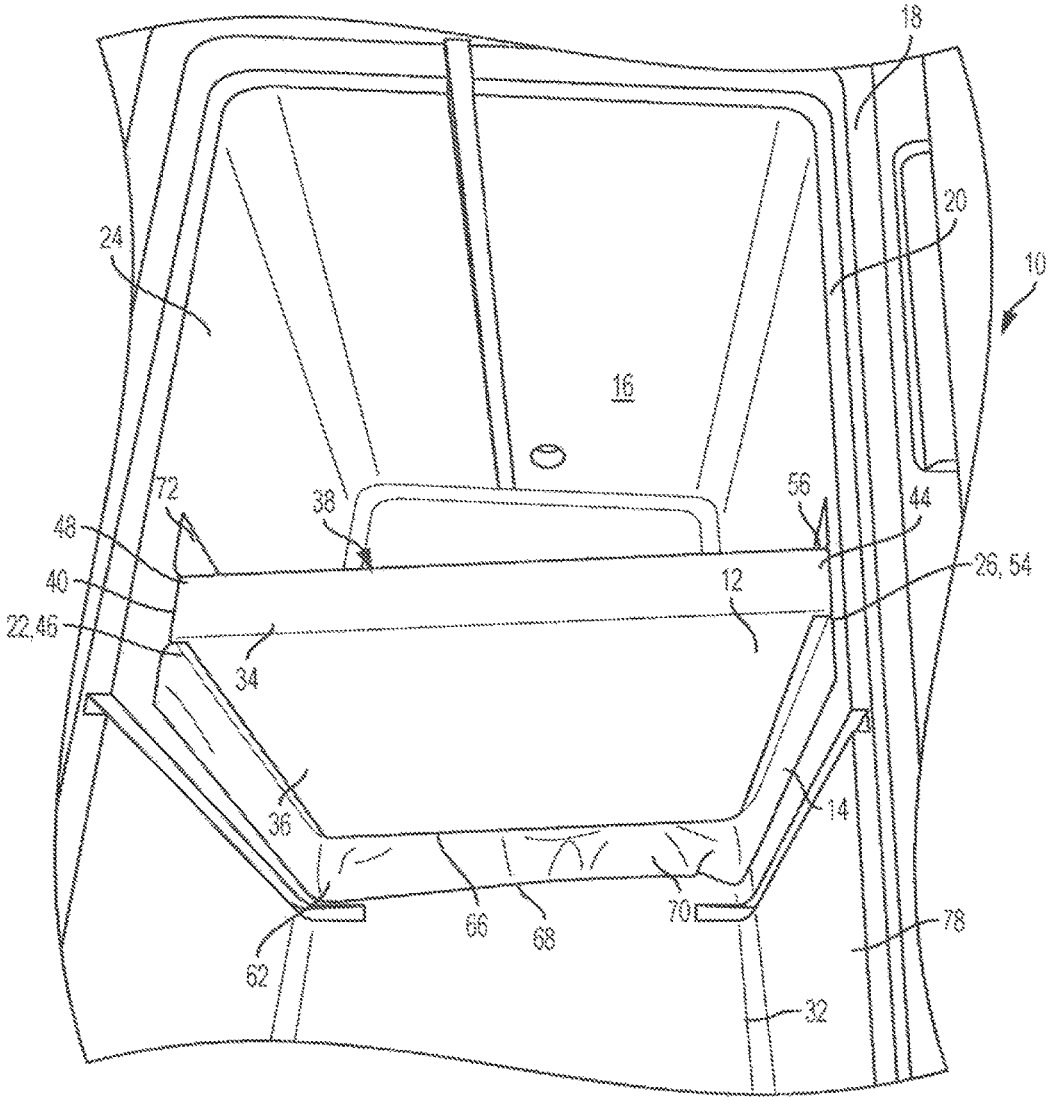
FIG. 1 is a perspective view of the device and system for dividing an interior chamber of a cooler into a plurality of separate chambers of the present application, showing a dividing wall positioned in the interior chamber of the cooler, according to one aspect.
Figure 2:
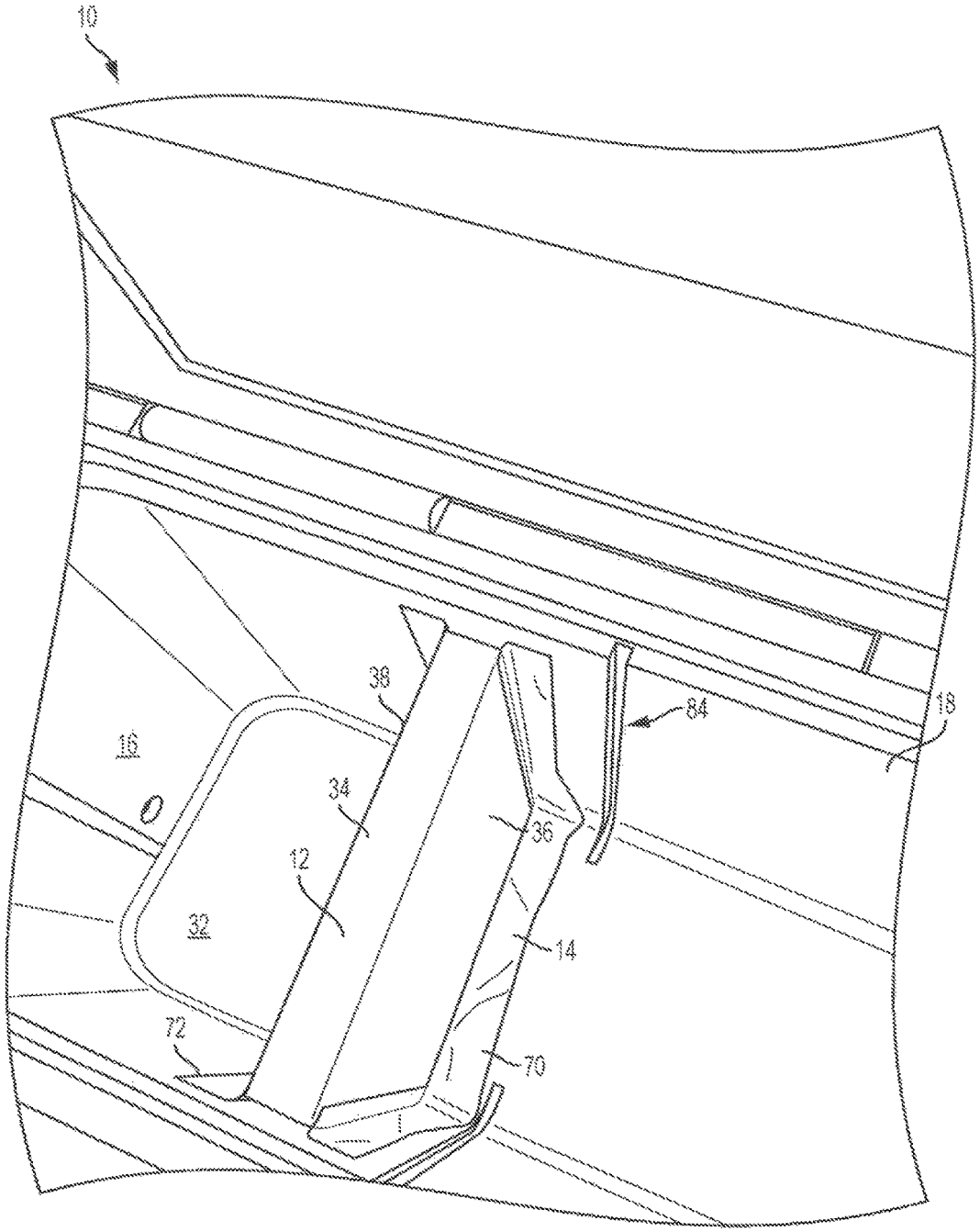
FIG. 2 is a second perspective view of the device of FIG. 1, showing the dividing wall positioned in the interior chamber.
Figure 3:
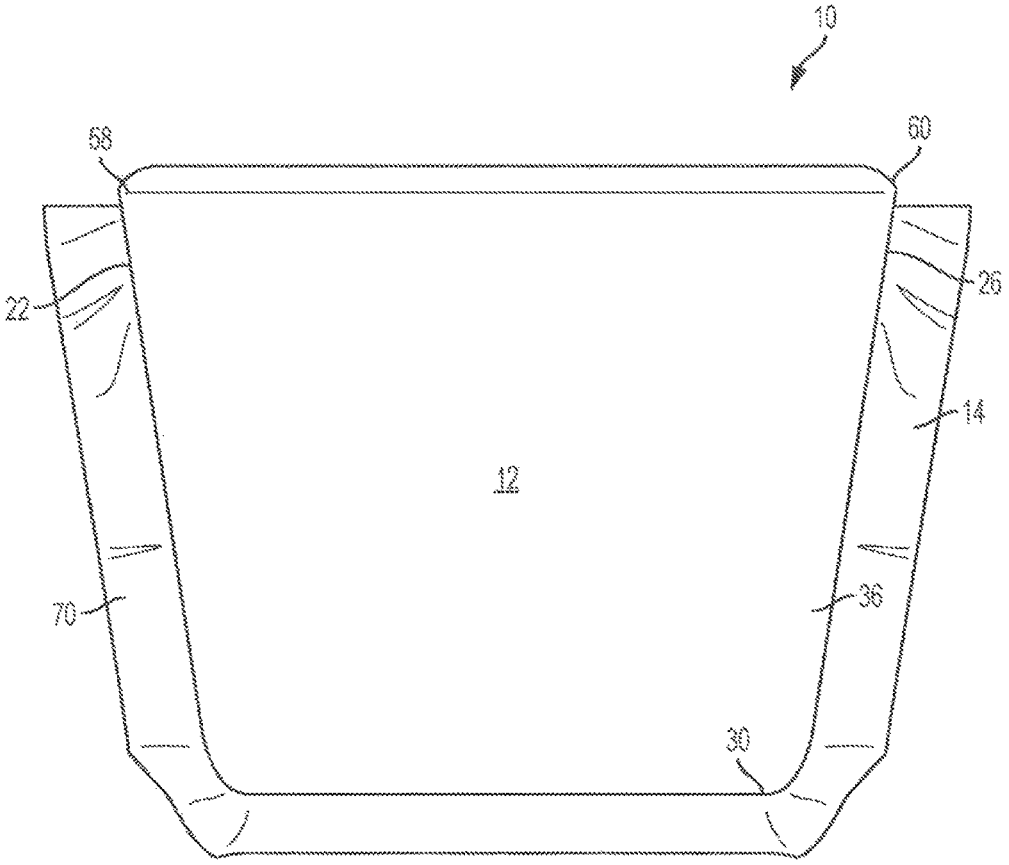
FIG. 3 is a front perspective view of the dividing wall of FIG. 1.
Figure 4:
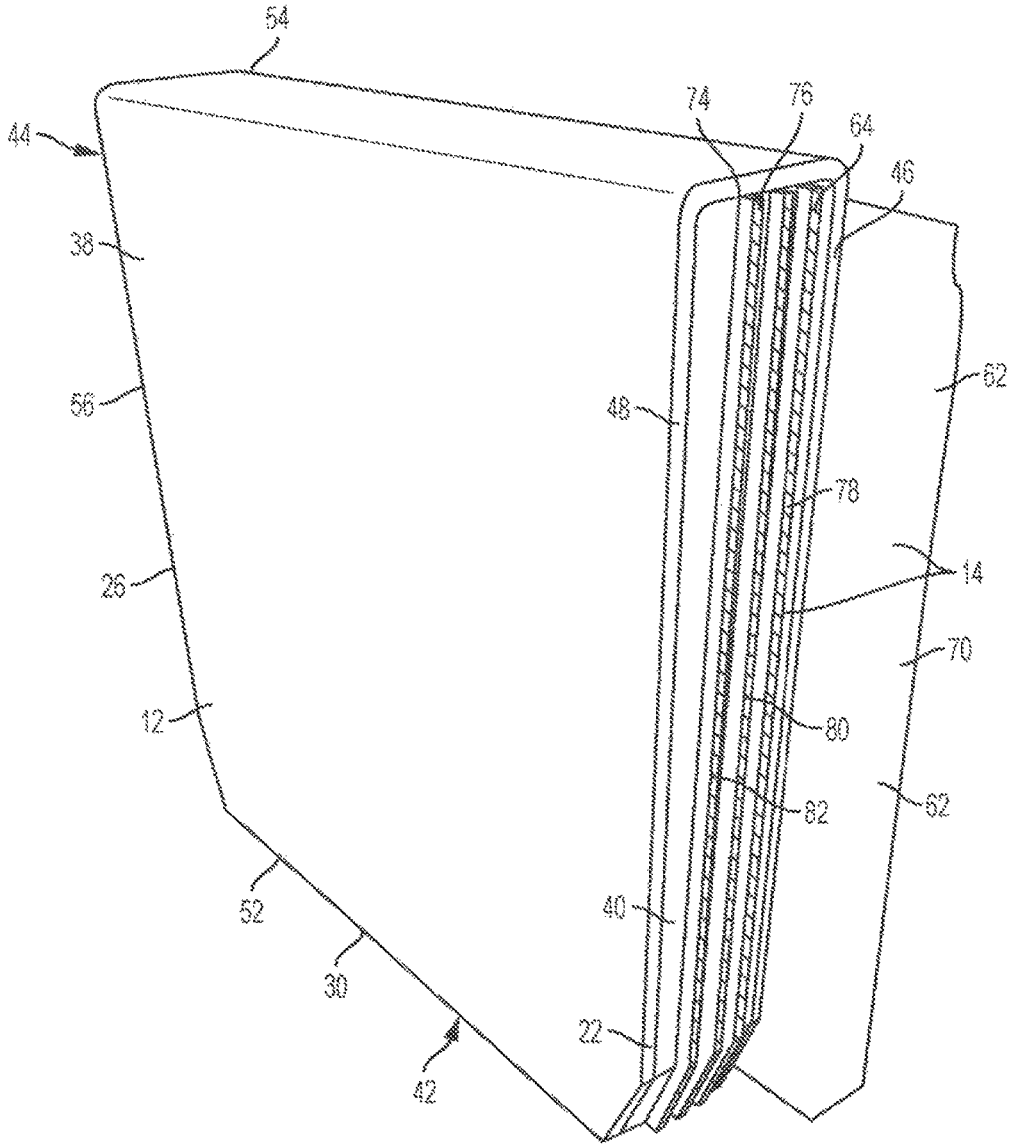
FIG. 4 is a side perspective view of the dividing wall of FIG. 1.
Figure 5:
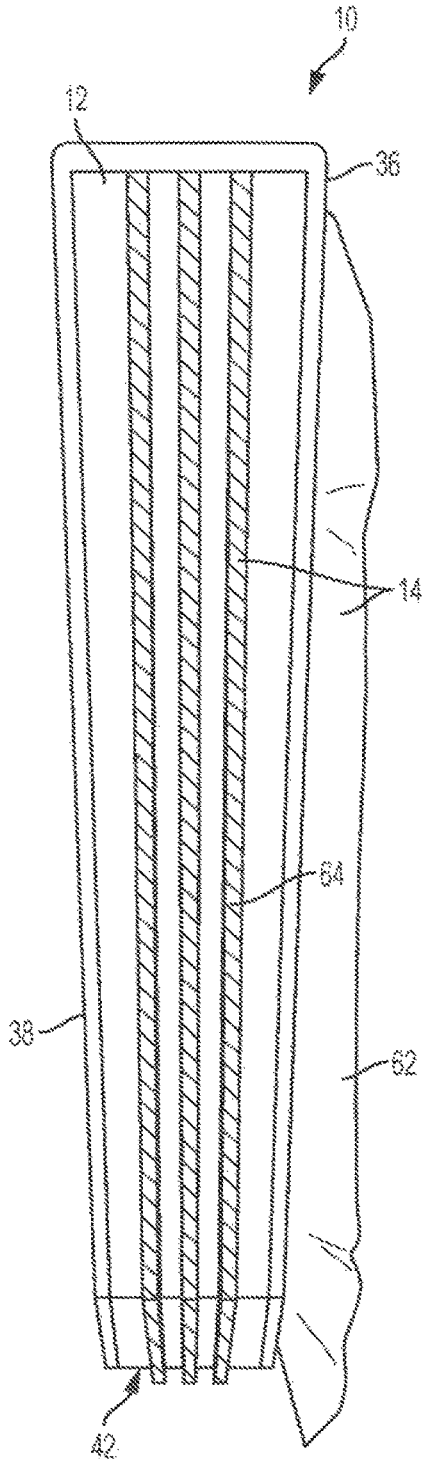
FIG. 5 is a side elevational view of the dividing wall of FIG. 1.
Figure 6:
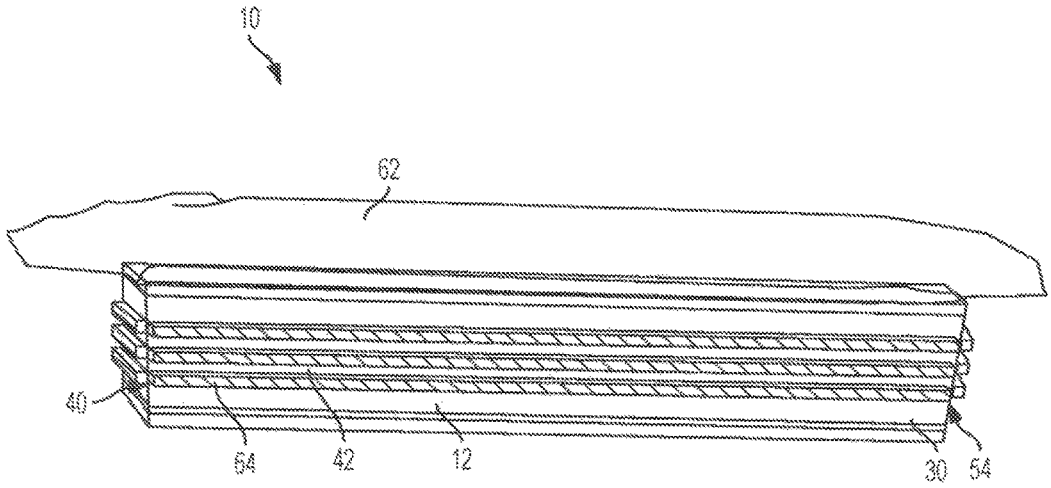
FIG. 6 is a bottom elevational view of the dividing wall of FIG. 1.
Figure 7C:
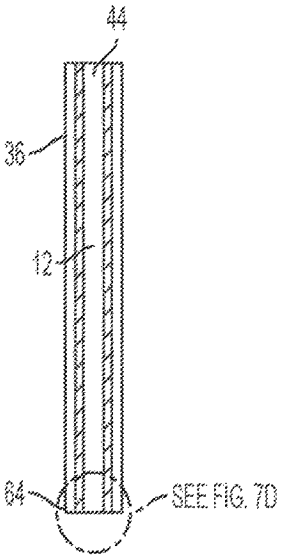
FIG. 7C is a side elevational view of the dividing wall of FIG. 1, according to one aspect.
Figure 7D:
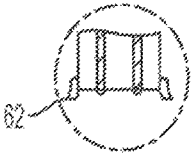
FIG. 7D is a cut out sectional view of a portion of FIG. 7C.
Figure 7A:
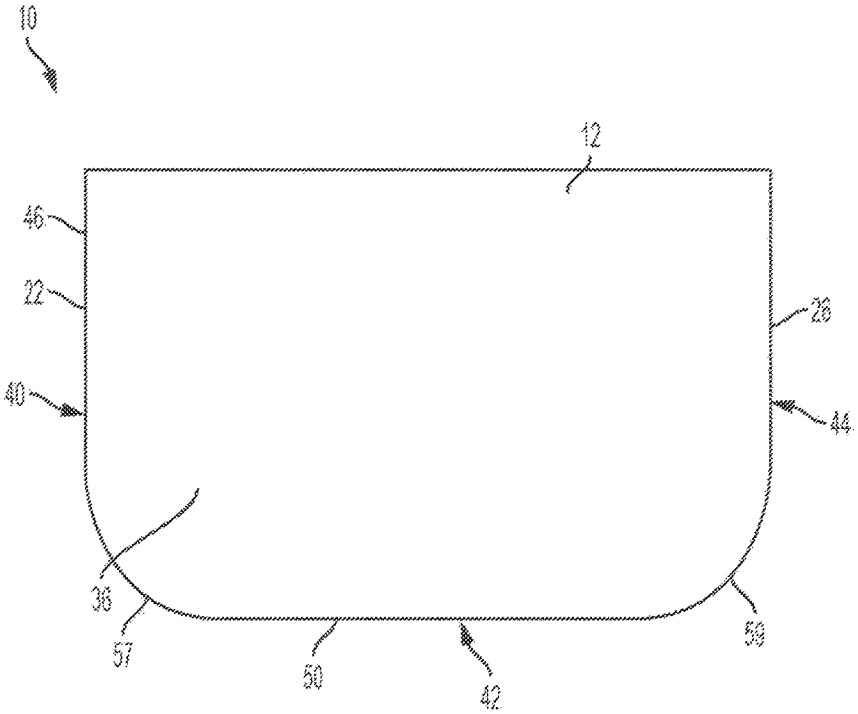
FIG. 7A is a front elevational view of the dividing wall of FIG. 1, according to one aspect.
Figure 7B:
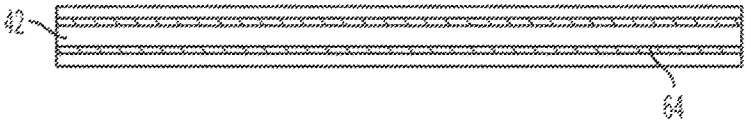
FIG. 7B is a bottom elevational view of the dividing wall of FIG. 1, according to one aspect.
Figure 8B:
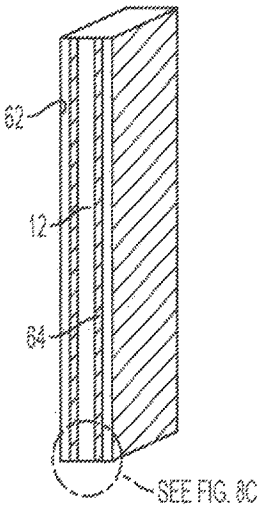
FIG. 8B is a side perspective view of the dividing wall of FIG. 1, according to one aspect.
Figure 8C:
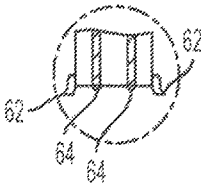
FIG. 8C is an exploded view of FIG. 8B.
Figure 8A:
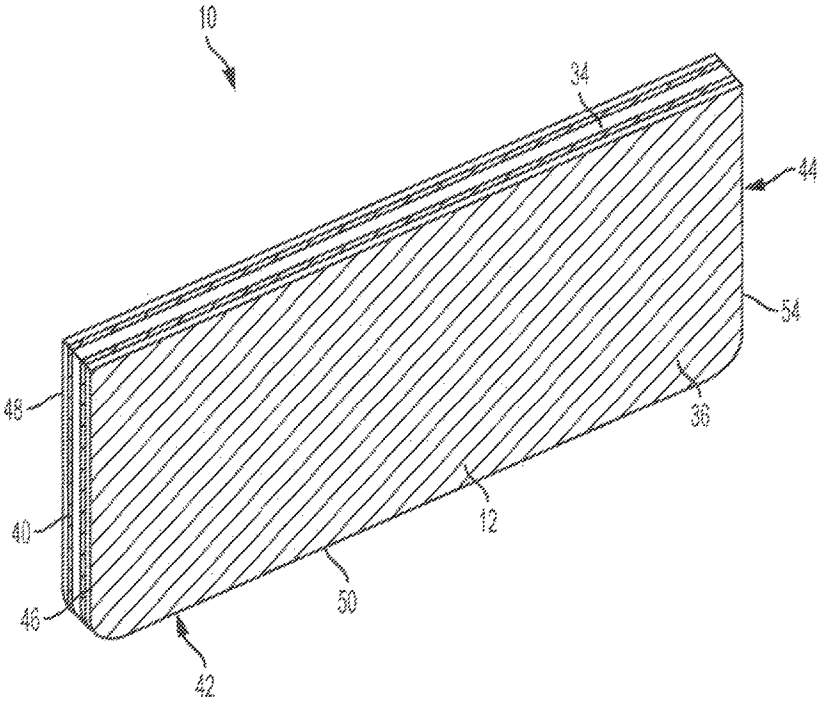
FIG. 8A is a front perspective view of the dividing wall of FIG. 1, according to one aspect.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof As used herein, the singular forms "a," "an" and "the" include plural referents unless the context clearly dictates otherwise. Thus, for example, reference to a "blade" includes aspects having two or more such blades unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The application relates to devices and systems for dividing an interior chamber of an ice chest or cooler into a plurality of separate chambers that prevent and/or restrict fluid flow among the plurality of chambers. As illustrated in the figures, the system 10 comprises a dividing wall 12 with a seal 14 positioned on at least one edge of the dividing wall. In one aspect, the dividing wall can be sized and shaped to correspond to the size and shape of the interior chamber 16 of a cooler 18 so that a complementary relationship can be formed between the dividing wall and an interior wall 20 of the cooler. That is, in use and described more fully below, the dividing wall 12 can be positioned in the interior chamber and at least a portion of the dividing wall can matingly engage the interior wall of the cooler to separate the interior chamber 16 into a plurality of chambers.

In one aspect, the dividing wall 12 can have a left edge 22 sized to correspond to the height of a first wall 24 of the interior chamber 16, and an opposed right edge 26 sized to correspond to the height of a second wall 28 of the interior chamber that is opposed to the first wall. In another aspect, the length of the dividing wall 12 (i.e., the distance between the left edge and the right edge) can correspond to the width of the interior chamber (i.e., the distance between the first wall 24 and the second wall 28). As used herein, "correspond" can mean "substantially the same" or, optionally, "slightly less than" such that a dimension of the dividing wall 12 can be slightly less than a mating dimension of the interior chamber 16 of the cooler 18 to allow the seal 14 to be positioned between the dividing wall and the walls of the interior chamber. In another aspect, the dividing wall can have a bottom edge 30 configured to be positioned on the bottom surface 32 of the interior chamber, and an upper edge 34 opposed to the bottom edge. The distance between the bottom edge and the upper edge can be substantially the same or less than the height of the interior chamber 16. For example, the distance between the bottom edge 30 and the upper edge 34 can be about 90%, 80%, 70%, 60%, 50%, 40%, 30%, 20% or about 10% of the height of the interior chamber 16.

The dividing wall 12 can have a first surface 36 and a second surface 38 that is spaced from the first surface by a thickness of the dividing wall. In one aspect, the dividing wall 12 can be formed from similar materials as those used to make the cooler 18. For example, if the cooler is a polyurethane foam cooler, the dividing wall can be formed from polyurethane foam. In one aspect, the dividing wall can have a thickness similar to a thickness of a wall of the cooler so that the dividing wall 12 can have similar insulating properties as the wall of the cooler. For example, if the wall of the cooler 18 is two inches thick and is formed from high impact plastic with an insulating core, the dividing wall 12 can be two inches thick and formed from high impact plastic with an insulating core (that is, the first surface 36 of the dividing wall can be spaced from the second surface 38 about two inches).

Optionally, in another aspect, the dividing wall 12 can have dissimilar insulating properties as the wall of the cooler 18. For example, the dividing wall can be non-insulated to promote heat transfer between the plurality of chambers formed in the interior chamber 16 of the cooler. Thus, in this aspect, the seal 14 can be positioned on at least a portion of the dividing wall to prevent and/or restrict fluid flow between the plurality of chambers formed by the dividing wall 12 while the dividing wall promotes heat transfer between the plurality of chambers relative to an insulated dividing wall.

In one aspect, a third surface 40 can extend along the left edge 22 of the dividing wall between the first surface 36 and the second surface 38, a fourth surface 42 can extend along the bottom edge 30 of the dividing wall between the first surface and the second surface, and a fifth surface 44 can extend along the right edge 26 of the dividing wall between the first surface 36 and the second surface 38. Each of the first, second, third, fourth and fifth surfaces can be substantially planar. Optionally, however, at least a portion of one of the first, second, third, fourth and fifth surfaces can be curved.

In one aspect, a first edge 46 can be formed at the intersection of the first surface 36 and the third surface 40, a second edge 48 can be formed at the intersection of the second surface 38 and the third surface, a third edge 50 can be formed at the intersection of the first surface and the fourth surface 42, a fourth edge 52 can be formed at the intersection of the second surface 38 and the fourth surface 42, a fifth edge 54 can be formed at the intersection of the first surface 36 and the fifth surface 44, and a sixth edge 56 can be formed at the intersection of the second surface 38 and the fifth surface. In another aspect, the intersection between the third surface 40 and the fourth surface 42 can be configured to correspond to the interior chamber of the cooler. For example, an intersection 57 between the third surface and the fourth surface can be curved to correspond to a radius in the interior chamber 16. Similarly, in another aspect, an intersection 59 between the fourth surface 42 and the fifth surface 44 can be configured to correspond to the interior chamber of the cooler 18. For example, the intersection between the fourth surface and the fifth surface can be curved to correspond to a radius in the interior chamber 16.

The seal 14 can comprise at least one sealing material positioned and/or formed on at least one of the left edge 22, the right edge 26 and the bottom edge 30 of the dividing wall 12. In one aspect, the seal 14 can be a continuous seal extending for the entire length of the left edge, the right edge and/or the bottom edge. Optionally, in another aspect, the seal 14 can be spaced from an upper end 58 of the left edge 22 and/or an upper end 60 of the right edge 26 by about less than ⅛ inch, about ⅛ inch, about ¼ inch, about ⅜ inch, about ½ inch, or more than ½ inch. The space between the seal and the upper end of the left edge can be substantially the same as the space between the seal 14 and the upper end of the right edge. Optionally, however, the space between the seal and the upper end 58 of the left edge 22 can be less than or greater than the space between the seal 14 and the upper end 60 of the right edge 26. In one aspect, at least a portion of the seal can be accordioned to accommodate sharp angles or curves in the interior chamber 16 of the cooler 18 while still maintaining a seal. It is contemplated, however, that in most cases the flexibility of the sealing material can allow for the sealing of sharp angles or curves in the interior chamber of the cooler while still maintaining a seal 14 without needing to be accordioned.

In one aspect and as illustrated in FIGS. 1-8, the seal 14 can comprise at least one blade 62 and at least one rib 64. The at least one blade and the at least one rib can be formed from a waterproof material, such as silicon, rubber and the like. The blade can have a predetermined width extending from a proximal edge 66 to a distal edge 68 of the blade. In another aspect, the blade can have a width of less than ¼ inch, about ¼ inch, about ½ inch, about ¾ inch, about 1 inch, about 1¼ inch, about 1½ inch, about 1¾ inch, about 2 inches, about 2¼ inches, about 2½ inches, about 2¾ inches, about 3 inches or greater than about 3 inches.

In a further aspect, the blade 62 can have a thickness of greater than about 1 inch, about ⅞ inch, about ¾ inch, about ⅝ inch, about ½ inch, about ⅜ inch, about ¼ inch, about ⅛ inch, about 1/16 inch, about 1/32 inch or less than about 1/32 inch. The thickness of the blade can be substantially constant between the proximal edge 66 and the distal edge 68, according to one aspect. Optionally, however, the thickness of the blade 62 can taper from the proximal edge to the distal edge. For example, the thickness of the blade at the proximal edge can be about ¼ inch and the thickness of the blade 62 at the distal edge can be about 1 mm.

The proximal edge 66 of the blade 62 can be coupled to or formed with the left edge 22, the right edge 26 and the bottom edge 30 of the dividing wall 12 so that the blade is a continuous blade, according to one aspect. In another aspect, the at least one blade can comprise a plurality of blades such that a first blade 70 is coupled to or formed with the first surface 36 of the dividing wall 12 and a second blade 72 is coupled to or formed with the second surface 38 of the dividing wall. For example, the blade can be coupled to or formed with any or all of the first edge 46, the second edge 48, the third edge 50, the fourth edge 52, the fifth edge 54 and the sixth edge 56. In another example the blade 62 can be coupled to or formed adjacent to any or all of the first, second, third, fourth, fifth and sixth edges.

In one aspect, the blade 62 can be coupled to or formed with the dividing wall 12 so that the distal edge 68 of the blade can extend away from the dividing wall at a predetermined angle. For example, the blade 62 can extend away from the dividing wall 12 at an acute angle between the blade and a plane of the surface of the dividing wall. In another example, the blade 62 can extend away from the dividing wall 12 at a substantially right angle between the blade and a plane of the surface of the dividing wall. In still another example, the blade 62 can extend away from the dividing wall 12 substantially parallel to a surface of the dividing wall.

The at least one rib 64 of the seal 14 can have a predetermined width extending from a proximal edge 74 to a distal edge 76 of the rib. In one aspect, the at least one rib 64 can have a width less than the width of the blade 62. In another aspect, the rib 64 can have a width of less than 1/32 inch, about 1/32 inch, about 1/16 inch, about ⅛ inch, about ¼ inch, about ⅜ inch, about ½ inch, about ⅝ inch, about ¾ inch, about ⅞ inch, about 1 inch or greater than 1 inch.

In a further aspect, the rib 64 can have a thickness of greater than about 1 inch, about ⅞ inch, about ¾ inch, about ⅝ inch, about ½ inch, about ⅜ inch, about ¼ inch, about ⅛ inch, about 1/16 inch, about 1/32 inch or less than about 1/32 inch. The thickness of the rib can be substantially constant between the proximal edge 74 and the distal edge 76 of the rib, according to one aspect. Optionally, however, the thickness of the rib 64 can taper from the proximal edge to the distal edge. For example, the thickness of the rib at the proximal edge 74 can be about ¼ inch and the thickness of the rib at the distal edge 76 of the rib 64 can be about 1 mm.

The proximal edge 74 of the rib 64 can be coupled to or formed with the third surface 40, the fourth surface 42 and/or the fifth surface 44 of the dividing wall 12, according to one aspect. For example, the rib can be coupled to or formed with the third surface, the fourth surface, and the fifth surface so that the rib 64 is a continuous rib extending around the left edge 22, the right edge 26 and the bottom edge 30 of the dividing wall.

In one aspect, the rib 64 can be coupled to or formed with the dividing wall 12 so that the distal edge 76 of the rib can extend away from the dividing wall at a predetermined angle. For example, the rib 64 can extend away from the dividing wall 12 at an acute angle between the rib and a plane of the surface of the dividing wall. In another example, the rib 64 can extend away from the dividing wall 12 at a substantially right angle between the rib and a plane of the surface of the dividing wall. In still another example, the rib 64 can extend away from the dividing wall 12 substantially parallel to a surface of the dividing wall.

In one aspect, the at least one rib 64 can comprise a plurality of ribs extending around the left edge 22, the right edge 26 and/or the bottom edge 30 of the dividing wall 12. Each of the plurality of ribs can be spaced from each other a predetermined distance. For example, a first rib 78 can be spaced from the first blade 70 a predetermined distance, a second rib 80 can be spaced from the first rib, and a third rib 82 can be spaced from the second rib and the second blade 72. In other examples, there can be a fourth, fifth, sixth, seventh, eighth, ninth, tenth or more than ten ribs. Each of the ribs can be substantially parallel to each other. Optionally, however, in one aspect, at least one rib 64 of the plurality of ribs can be at an acute angle relative to an adjacent rib. In another aspect, the predetermined distance between each of the ribs 64 and/or blades 62 can be substantially the same. Optionally, however, the predetermined distance between each of the ribs and/or blades can be different. In use, the dividing wall 12 can be selectively positioned in the interior chamber 16 of the cooler 18 so that the dividing wall separates the interior chamber into two separate chambers. The seal 14 of the dividing wall can prevent fluid from flowing between the two separate chambers. In one aspect, at least a portion of the seal 14 positioned on the left edge 22 and/or the third surface 40 of the dividing wall 12 can contact the first wall 24 of the interior chamber, at least a portion of the seal positioned on the bottom edge 30 and/or the fourth surface 42 of the dividing wall can contact the bottom surface 32 of the interior chamber 16, and at least a portion of the seal 14 positioned on the right edge 26 and/or the fifth surface 44 of the dividing wall can contact the second wall 28 of the interior chamber. In this aspect, the contact between seal and the wall or surface of the interior chamber 16 can prevent fluid from passing the seal 14.

To form the fluid-tight seal, in one aspect, the first blade 70 of the seal 14 can extend away from the first surface 36 of the dividing wall 12. As the first blade can be formed from a waterproof material, such as silicon, rubber and the like, the first blade can contact the first wall 24, the second wall 28, and the bottom surface 32 to prevent or restrict fluid from passing the first blade. Similarly, the at least one rib 64 can extend away from the third surface 44, the fourth surface 46, and the fifth surface 48 of the dividing wall. As each rib of the at least one rib can be formed from a waterproof material, each rib 64 can contact the first wall 24, the second wall 28, and the bottom surface 32 to prevent or restrict fluid from passing past each rib. Finally, in one aspect, the second blade 72 of the seal can extend away from the second surface 38 of the dividing wall 12. As the second blade can be formed from a waterproof material, the second blade can contact the first wall 24, the second wall 28, and the bottom surface 32 to prevent or restrict fluid from passing past the second blade. Thus, even if a non-perfect seal is formed between a blade 64 and/or a rib 66 and the interior chamber 16, the redundant ribs and/or blade can still prevent fluid from passing from the first surface 36 of the dividing wall past the seal 14 and to the second surface 38.

Figure 9:
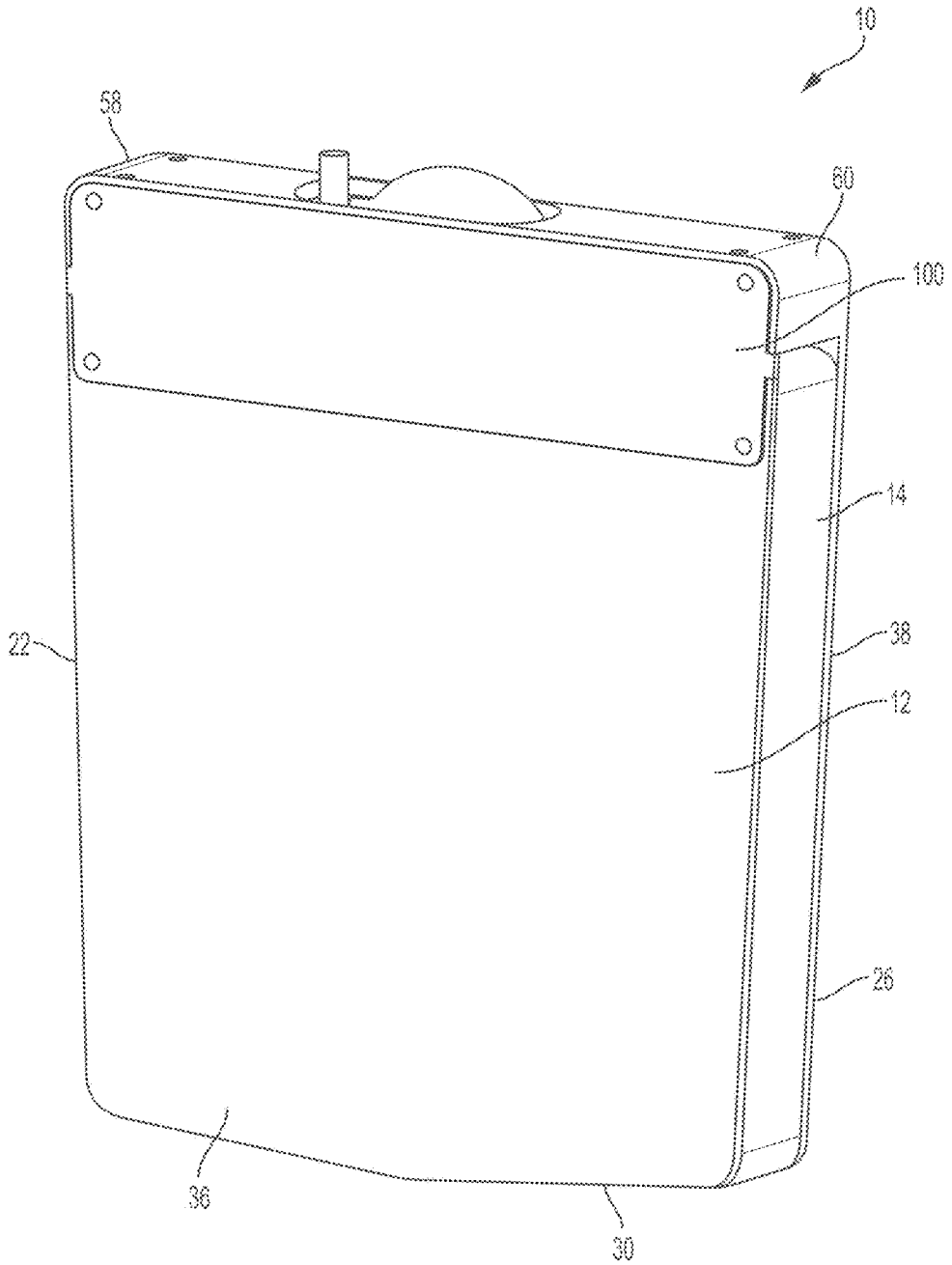
FIG. 9 is a front perspective view of a dividing wall of the device and system for dividing an interior chamber of a cooler into a plurality of separate chambers of the present application, according to one embodiment.
Figure 10:
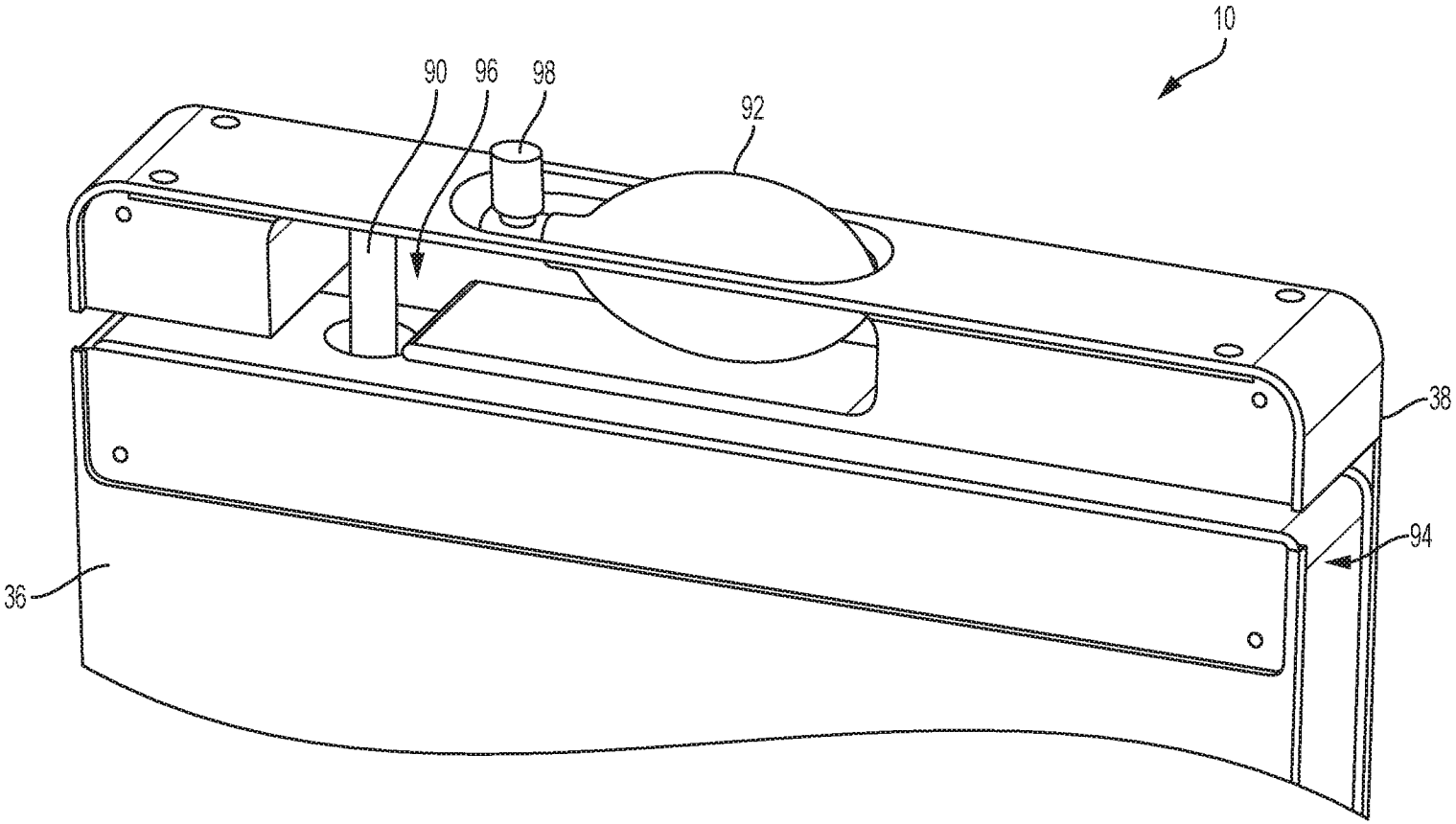
FIG. 10 is a magnified, cut-away view of a portion of the dividing wall of FIG. 9.

In one embodiment and as illustrated in FIGS. 9-10, the seal 14 can comprise at least one inner tube 90, at least one pump 92 and at least one seal body 94. The at least one inner tube and the at least one seal body can be formed from a waterproof material, such as silicon, rubber and the like. The at least one pump can inflate the inner tube so that the tube exerts a desired pressure on the seal. Portions of the inner tube 90, the at least one pump 92 and the at least one seal body can be positioned within a wall chamber 96 defined between the first surface 36 and the second surface 38 of the dividing wall 12. Optionally, at least one removable panel 100 can be provided to provide access to the wall chamber 96 through the first surface and/or the second surface.

In this aspect, the at least one inner tube 90 can be positioned between the first surface 36 and the second surface 38 of the dividing wall 12. For example, the inner tube can be positioned adjacent or near the left edge 22, the right edge 26 and/or the bottom edge 30 of the dividing wall 12. Optionally, the at least one inner tube can comprise a plurality of inner tubes. For example, a first inner tube can be positioned adjacent the left edge, a second inner tube can be positioned adjacent the right edge, and a third inner tube can be positioned adjacent a bottom edge of the dividing wall 12. The at least one inner tube can have a tube chamber that is in sealed fluid communication with the at least one pump 92.

The at least one seal body 94 can be a flexible seal body coupled to the inner tube 90. Alternatively, the at least one seal body can be coupled to the left edge 22, the right edge 26, and/or the bottom edge 30 of the dividing wall 12. That is, the seal body can be formed with or positioned adjacent to an edge of the outer wall so that the seal body is a continuous seal extending around at least a portion of the left edge, the right edge and the bottom edge of the dividing wall. Optionally, in another aspect, the seal body 94 can be spaced from the upper end 58 of the left edge 22 and/or the upper end 60 of the right edge 26 by about less than ⅛ inch, about ⅛ inch, about ¼ inch, about ⅜ inch, about ½ inch, or more than ½ inch. The space between the seal body and the upper end of the left edge can be substantially the same as the space between the seal body 94 and the upper end of the right edge.

In another aspect, without pressure being exerted by the inner tube 92 on the seal body 94, the seal body can be positioned within the wall chamber 96. When pressure is exerted by the inner tube 92 on the seal body 94, the seal body can extend away from the wall a predetermined distance and at a predetermined angle.

In one aspect, the seal body 94 can have a seal width substantially the same as the width of the dividing wall 12. Optionally, the seal width can be slightly less or much less than the width of the dividing wall.

The at least one pump 92 can be a conventional pump, such as a ball pump and the like configured to provide air pressure. In one aspect, at least a portion of the pump can be positioned within the wall chamber 96 defined between the first surface 36 and the second surface 38 of the dividing wall 12. The pump can be in sealed fluid communication with the inner tube 90 so that air pressure exerted by the pump can be applied to the tube chamber of the inner tube. A valve 98 can be provided to restrict or restrict air from flowing between the pump 92 and the tube 90.

To assemble the seal 14 of this embodiment, the inner tube 90 can be positioned in the wall chamber 96 defined between the first surface 36 and the second surface 38 of the dividing wall 12. The at least one pump can be coupled to the inner tube with other tubes, fasteners and the like so that the at least one pump is in sealed fluid communication with the tube chamber of the tube. Optionally, at least a portion of the pump can be positioned in the wall chamber 96. The seal body 94 can be coupled to the at least one inner tube 90 and/or the left edge 22, the right edge 26, and/or the bottom edge 30 of the dividing wall 12 so that the seal body is a continuous seal extending around at least a portion of the left edge, the right edge and the bottom edge of the dividing wall.

In use, the dividing wall 12 can be positioned in the interior chamber 16 of the cooler 18 with the left edge positioned adjacent to the first wall 24 of the interior chamber 16, the right edge 26 positioned adjacent to the second wall 28, and the bottom edge 30 positioned adjacent to the bottom surface 32 of the interior chamber 16. A user can selectively engage the pump 92 to pressurize the inner tube 90 to a desired pressure, and the pressurized inner tube can urge the seal body 94 away from the dividing wall 12. At the desired pressure, the inner tube can urge the seal body into contact with the first wall, the second wall, and the bottom surface so that a liquid-tight seal is formed between the dividing wall and the cooler 18.

If the dividing wall 12 is to be moved to a different location in the cooler 18 or removed altogether, air pressure can be released from tube chamber of the inner tube 90 so that the seal body 94 is not urged away from the dividing wall. For example, the valve 98 can be opened to release air pressure from the tube chamber.

In one aspect, the dividing wall 12 does not need to be positioned in a groove 84 defined in the interior chamber 16. That is, the dividing wall can be securedly fixed in any desired position in the interior chamber by a friction fit formed between at least a portion of the seal 14 and the wall or bottom surface of the interior chamber without being positioned in the groove. As can be appreciated, liquids trapped in the groove 84 during use with conventional dividers can breed microorganisms such as bacteria and the like. In another aspect, the dividing wall can be formed integrally within the interior chamber 16. That is, in this aspect, the dividing wall can be manufactured in place in the interior chamber to prevent fluid flow between the plurality of chambers formed by the dividing wall.

In order to accommodate coolers 18 of various sizes, a plurality of dividing walls 12 can be coupled together to form a larger dividing wall. For example, a tongue can be formed in the left edge 22 of a first dividing wall segment, and a groove can be defined in the right edge 26 of a second dividing wall segment. The tongue of the first segment can slide in the groove of the second segment to form the larger dividing wall. Similar mating concepts, such as a dovetail joint and the like are contemplated. The seal 14 as described herein can prevent fluid from flowing between the first dividing wall segment and the second dividing wall segment.

Optionally, a plurality of dividing walls 12 can be provided to be selectively positioned in the interior chamber 16 of the cooler 18 so that the plurality of dividing walls separates the interior chamber into more than two separate chambers.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A divider device for an interior chamber of a cooler, the divider device comprising:

a dividing wall sized and shaped to correspond to the size and shape of the interior chamber of the cooler; and a seal supported on the dividing wall, the seal comprising at least one seal body, at least one inner tube, and at least one pump that is part of the dividing wall and is in fluid communication with the at least one inner tube for expanding the inner tube in relation to the seal body;

wherein the dividing wall is insertable into the interior chamber of the cooler, and the at least one inner tube is pressurizable by the at least one pump to urge the at least one seal body into contact with an inner surface of the cooler, such that the dividing wall and the seal divide the interior chamber of the cooler into a plurality of separate chambers and prevent fluid flow between individual chambers of the plurality of separate chambers.

2. The divider device of claim 1, wherein the at least one inner tube comprises a tube chamber that is in sealed fluid communication with the at least one pump.

3. The divider device of claim 1, wherein the dividing wall has a first surface, and a second surface opposite the first surface, and wherein the at least one inner tube is positioned between the first surface and the second surface of the dividing wall.

4. The divider device of claim 1, wherein the at least one inner tube comprises a plurality of inner tubes.

5. The divider device of claim 1, wherein the dividing wall has a first edge, a second edge opposite the first edge, and a third edge extending between the first edge and the second edge, wherein the first edge is sized to correspond to a height of a first wall of the interior chamber, wherein the second edge is sized to correspond to a height of a second wall of the interior chamber that is opposed to the first wall and wherein the third edge is configured to be positioned on a bottom surface of the interior chamber.

6. The divider device of claim 5, wherein the seal comprises at least one seal body positioned on at least one of the first edge, the second edge and the third edge of the dividing wall.

7. The divider device of claim 5, wherein the at least one seal body comprises a flexible seal body coupled to at least one of the first edge, the second edge, and the third edge of the dividing wall.

8. The divider device of claim 1, wherein the at least one seal body comprises a flexible seal body coupled to the at least one inner tube.

9. The divider device of claim 1, wherein the at least one seal body comprises a flexible seal body coupled to and forming a continuous seal extending around at least a portion of the first edge, the second edge, and the third edge of the dividing wall.

10. The divider device of claim 1, wherein the at least one inner tube and the at least one seal body are formed from a waterproof material.

11. The divider device of claim 1, wherein the at least one pump is configured to provide air pressure.

12. The divider device of claim 11, wherein the at least one pump comprises a ball pump.

13. The divider device of claim 1, wherein the dividing wall has a first surface, and a second surface opposing the first surface, wherein the dividing wall defines an internal wall chamber between the first surface and the second surface of the dividing wall, and wherein at least a portion of the at least one pump is positioned within the wall chamber.

14. The divider device of claim 13, further comprising:

at least one removable panel matable to the dividing wall and removable from the dividing wall to provide access to the wall chamber.

15. The divider device of claim 1, further comprising a valve connected to restrict a pressurized flow between the at least one pump and the at least one inner tube.

16. The divider device of claim 1, wherein the at least one seal body is coupled to the inner tube.

17. A divider device comprising:

a dividing wall having at least one edge; and a seal comprising at least one inner tube, at least one seal body positioned along the at least one edge of the dividing wall adjacent the at least one inner tube, and at least one pump that is part of the dividing wall and is in sealed fluid communication with the at least one inner tube for pressurizing the inner tube and expanding the at least one seal body away from the at least one edge of the dividing wall, wherein the dividing wall is insertable into a correspondingly sized and shaped interior chamber of a cooler, and wherein the at least one inner tube is pressurizable by the at least one pump, to urge the at least one seal body into contact with an inner surface of the cooler such that the dividing wall and the seal cooperate to divide the interior chamber into a plurality of separate chambers and prevent fluid flow between individual chambers of the plurality of separate chambers.

18. The divider device of claim 17, wherein the at least one seal body is coupled to the inner tube.

19. A divider device for an interior chamber of a cooler, the divider device comprising:

a dividing wall sized and shaped to correspond to the size and shape of the interior chamber; and a seal supported on the dividing wall, the seal comprising at least one seal body, at least one tube, and at least one pump that is part of the dividing wall and is in fluid communication with the at least one tube for expanding the tube in relation to the seal body;

wherein the dividing wall is insertable into the interior chamber of the cooler, and the at least one tube is pressurizable by the at least one pump to urge the at least one seal body into contact with an inner surface of the cooler, such that the dividing wall and the seal divide the interior chamber of the cooler into a plurality of separate chambers.

20. The divider device of claim 19, wherein the dividing wall has a first surface, and a second surface opposing the first surface, wherein the dividing wall defines an internal wall chamber between the first surface and the second surface of the dividing wall, and wherein at least a portion of the at least one pump is positioned within the wall chamber.

21. The divider device of claim 20, further comprising:

at least one removable panel matable to the dividing wall and removable from the dividing wall to provide access to the wall chamber.

22. The divider device of claim 19, wherein the at least one seal body is coupled to the inner tube.

* * * * *